United States Patent [19]

Cohen

[11] 4,187,621

[45] Feb. 12, 1980

[54] SHOE INNERSOLE

[76] Inventor: Leon H. Cohen, c/o Way Distributors 150 Gould St., Needham Heights, Mass. 02194

[21] Appl. No.: 898,935

[22] Filed: Apr. 24, 1978

[51] Int. Cl.[2] ..... A43B 13/40

[52] U.S. Cl. ..... 36/44; 428/315

[58] Field of Search ..... 36/44, 43; 428/315, 428/311, 310

[56] References Cited

U.S. PATENT DOCUMENTS

| | | | |
|---|---|---|---|
| B 452,672 | 1/1976 | Ogden | 428/315 X |
| 3,118,153 | 1/1964 | Hood | 428/310 X |
| 3,638,336 | 2/1972 | Silverman | 36/44 |
| 4,017,656 | 4/1977 | Lasman et al. | 428/315 X |
| 4,055,699 | 10/1977 | Hsiung | 36/44 X |

FOREIGN PATENT DOCUMENTS

| | | | |
|---|---|---|---|
| 1243575 | 8/1971 | United Kingdom | 36/44 |

*Primary Examiner*—James Kee Chi

*Attorney, Agent, or Firm*—Jerry Cohen

[57] ABSTRACT

A molded innersole for athletic and other shoes provides comfort and healthful distribution of weight on the foot through a construction which has laminated layers. A bottom layer of greater density and rigidity than a top layer (towards the foot of the wearer) with the construction of the top layer being softer and designed to take a partial compression set to produce a substantially permanent image of the wearer's toes, metatarsal arch and ball of the foot, at least. The upper soft layer is made of a closed cell foam and affords high impact absorption. The bottom layer is a firmer construction and performs the function when molded of retaining the general shape of the last used to make a specific shoe. Preferably both of these layers are made substantially of cross-linked polyethylene. Preferably a fabric moisture absorbing layer is provided above the said top layer, although other top layers may be used. The product is also highly resistant to tear and abrasion.

4 Claims, 5 Drawing Figures

SHOE INNERSOLE

BACKGROUND OF THE INVENTION

The present invention relates to innersoles for athletic and other shoes and is characterized in providing comfort, healthful distribution of weight on the foot and impact dampening and absorption of shock and further in being easily and economically manufacturable. The product is also highly resistant to tear and abrasion.

It is an important object of the invention to provide a molded innersole which further molds to the shape of the foot of a wearer as he wears it, affording a high degree of comfort consistent with good impact resistanct and healthful distribution of weight on the feet in substantially all situations of normal usage.

It is a further object of the invention to provide such an innersole which is readily manufacturable, and economically so, and a process for such manufacture, consistent with the preceding object.

It is a further object of the invention to provide a mass producible and mass distributable innersole which effects its own tailoring to the foot of the individual wearer, consistent with one or more of the preceding objects.

SUMMARY OF THE INVENTION

To meet the foregoing objects, an innersole is made by laminating relatively soft and hard expanded plastics, preferably polyethylene in both layers. A bottom layer (next to the outer sole) comprises a softened cross-linked polyethylene, preferably with a density of 100–180 kilograms per cubic meter, 130–150 being optimal in most cases, and a compression set of about 1–6% (3% usually being associated with 147 kg/m$^3$ density). The top layer adjacent to the wearer's foot would be thicker than the bottom layer, have a density of 30–100, preferably 60–80 and a compression set on the order of 20–40%. This softer material would tend to have one compression set which would reduce to a lower level after some relaxation, occurring over periods which may vary from a few minutes to several hours. The desired compression set after such recovery would be 15–30%. The top layer is in closed cell form and resists moisture penetration. The layers of the laminate are bonded, preferably by self adhesion through flaming prior to holding together. A moisture absorption layer, or other material is similarly adhered to the upper surface of the top layer by flaming such surface and simultaneously applying the upper material.

A laminate material described above with size for one or more (preferably many more) innersole units is molded under low pressure to innersole shapes by single or multiple cavity molds having lower and upper pieces which are fastened down upon the heated laminate (heated to the range of 200°–400° F.) to establish the shape of the softened material of about ½ the total (comprising 40–60%) thickness in a shape conforming to the last of the shoe. The material is cooled within the mold and generally forms an innersole shape which conforms to the last. It will be understood that thickness varies from part to part of the innersole so formed. When the innersole is placed in the shoe and worn, the user's foot applies compression to the soft layer which sets into a substantially permanent image of the user's metatarsal arch, toes and ball of the foot. This self sculptured innersole becomes more and more comfortable to the user with increasing wear, distributes the weight load so that each part of the foot carries its own proper share of weight—toes, instep, metatarsal arch, ball, heel. The closed cell structure of the top layer resists moisture penetration to the extent that any which gets through the fabric layer is blocked and dries quickly. Such closed cell structure also provides impact dampening action from jumping and other athletic exercises to reduce fatigue or the dangers of damage in the nature of bruises or small bone cracking. The resistance to moisture of the top layer also provides related resistance to fungus, chemicals and odors.

Through the low pressure molding, the expense and difficulty of conventional high pressure molding equipment and processing is avoided.

Other objects, features and advantages of the invention will become apparent from the following detailed description of preferred embodiments.

DETAILED DESCRIPTION OF PREFERRED EMBODIMENTS

Figure 1:
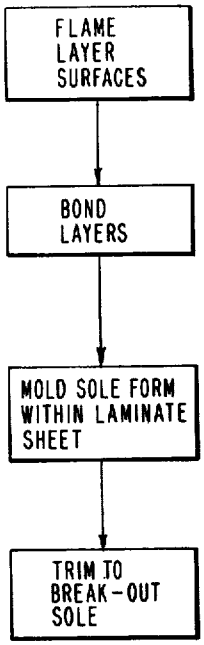
FIG. 1 is a block diagram of processing used in practice of the present invention.

FIG. 1 shows the steps of practice of the present invention, according to a preferred embodiment thereof, comprising, first, preparing surfaces for bonding such as by flaming them; second, bonding surfaces by passage through rollers; third, molding the sole by establishment of a low pressure on the laminate and/or a restraint, after heating to soften it, to a mold shape which is retained by the laminate on cooling [the mold is built with toggle clamps and hinges to keep pressure constant while the laminate cools]; fourth, trimming away flashing of the laminate from around the inner sole.

Figure 2:
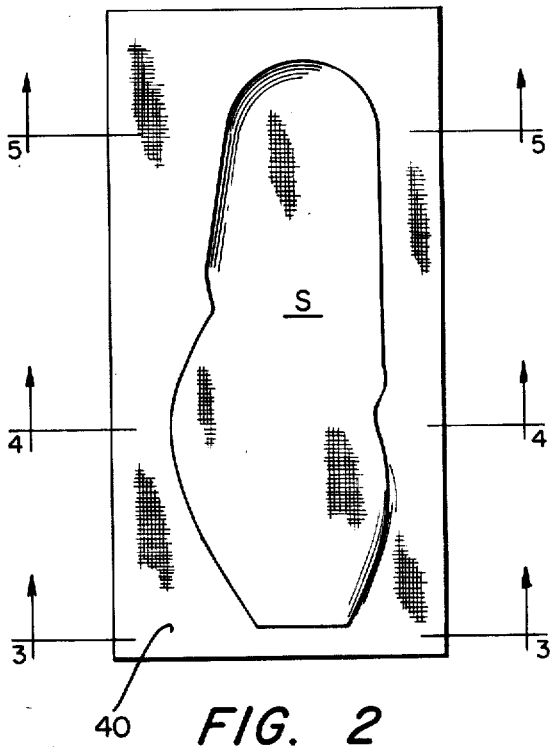
FIG. 2 is a plan view of a laminate with a molded sole therein.
Figure 3:
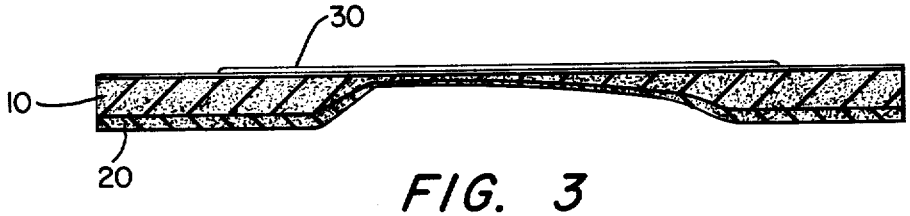
FIGS. 3–5 are sections through the FIG. 2 laminate toe, ball and heel sections respectively, taken as indicated by arrows 3—3, 4—4, 5—5 in FIG. 2.
Figure 4:
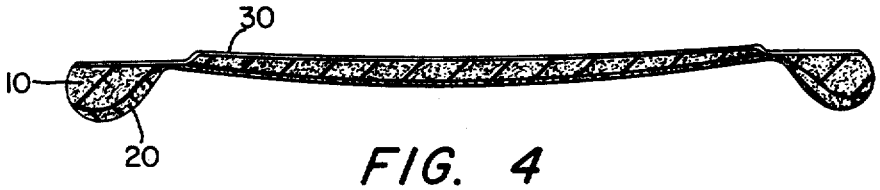
Figure 5:
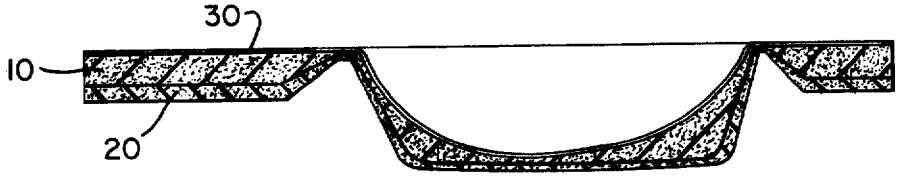

FIG. 2 shows a plan view of the molded soles before trimming away the flashing and sections thereof are shown in FIGS. 3–5 at the toe, ball and heel sections, respectively. It is seen that the thickness of the two layers is viable in cross section to accommodate the foot with proper resilience and support at various points.

The upper (lower density) plastic layer is indicated at 10, the lower (high density) layer at 20 and fabric covering at 30. The flashing is indicated at 40.

The preferred material to use in differing densities for the two principal layers of the product of the invention comprises closed cell cross-linked cellular polyethylene which is tough and abrasion resistant, but flexible. The material is cross-linked, and because of its cross-linking the material shows little deterioration under outdoor exposure, is resistant to chemicals and perspiration.

The top layer 10 has a compression set of approximately 30% which relaxes over a period of about six hours to a more nearly permanent set of 20%. The bottom layer 20 has about 3% compression set. The visible reverse impression of the foot which is left is a distinct result of the present invention.

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of feature present in, or po-sessed by, the apparatus and techniques herein disclosed and limited solely by the scope and spirit of the appended claims.

What is claimed is:

1. Innersole for athletic shoes and the like comprising, a molded laminate of two layers completely bonded at their interface and cut and conformed in contour and varying thickness thereof to the last shape of the shoe with which the innersole is associated, the laminate having, a relatively soft upper (towards the foot of the wearer) layer of 30–100 kilograms per cubic meter density and a compression set of 20–40% cellular plastic material and, a lower layer of relatively hard cellular plastic material of 100–200 kilogram per cubic meter density and 1–6% compression set.

2. The product of claim 1 wherein both layers comprise cross-linked, closed cell polyethylene of different densities.

3. The product of either of claims 1 or 2 as made by forming a laminate, as described, in a first thickness (of the total) and molding under low pressure, less than 500 lbs. per square inch, to final thickness of about half of the original and which conforms to the last of the shoe with which the innersole will be associated.

4. Product of either of claims 1 or 2 wherein the material components are selected and constructed so that the molded laminate combination thereof is further molded to depart from the general shape of the last to conform to the specific shape of each individual foot while it is being worn and to take a permanent set in the latter form.

* * * * *